US005412459A

United States Patent [19]

Borsuk et al.

[11] Patent Number: 5,412,459

[45] Date of Patent: May 2, 1995

[54] IMAGING APPARATUS WITH PAPER PRECONDITIONING FOR TRANSFER

[75] Inventors: John E. Borsuk, Nicholasville; Kuangti T. Cheng, Lexington; Joe D. Moss, Nicholasville; Robert G. Newman; Pramod K. Sharma, both of Lexington, all of Ky.

[73] Assignee: Lexmark International, Inc., Greenwich, Conn.

[21] Appl. No.: 200,979

[22] Filed: Feb. 24, 1994

[51] Int. Cl.[6] ..... G03G 15/14; G03G 21/00

[52] U.S. Cl. ..... 355/273; 355/200; 355/271

[58] Field of Search ..... 355/200, 210, 271, 273

[56] References Cited

U.S. PATENT DOCUMENTS

| | | | |
|---|---|---|---|
| 3,634,007 | 1/1972 | Verderber et al. | 355/309 X |
| 4,193,680 | 3/1980 | Yoshikawa et al. | 355/273 |
| 4,639,405 | 1/1987 | Franke | 355/290 X |
| 4,645,327 | 2/1987 | Kimura et al. | 355/200 |
| 5,081,502 | 1/1992 | Mitsuya et al. | 355/215 X |
| 5,099,281 | 3/1992 | Bhagat | 355/273 X |
| 5,204,722 | 4/1993 | Thompson et al. | 355/279 |
| 5,291,225 | 3/1994 | Britto et al. | 355/285 |

*Primary Examiner*—Fred L. Braun
*Attorney, Agent, or Firm*—John A. Brady

[57] ABSTRACT

In an electrostatic printer (1) paper (11) is first conditioned by being thoroughly dried by rollers (13 and 15), which also immobilize the paper so that it does not wrinkle. The paper is then kept hot on flat plate 17 before it moves into the transfer nip of intermediate transfer drum (5) and transfer roller (7). The paper does not wrinkle on the plate and toner image is transferred to a wide range of papers with exceptional quality and consistency.

6 Claims, 2 Drawing Sheets

IMAGING APPARATUS WITH PAPER PRECONDITIONING FOR TRANSFER

TECHNICAL FIELD

This invention relates to electrophotographic printing and copying and, more specifically, to transferring final toner images with heat. Transfer by heat results in image formed of toner particles being melted on paper or other substrate, where they may be subsequently further melted in a separate fixing step. The toner is then solidified at room temperature into a permanent image.

BACKGROUND OF THE INVENTION

Transferring and fixing the final image with heat is widely standard in electrophotographic apparatus. In U.S. Pat. No. 5,291,225 to Britto et al, Ser. No. 07/945,195, filed Sept. 15, 1992, heating is in two stages, the final stage being the paper pressed between a member carrying the image and a heated transfer roller. Immediately preceding that stage is a heated, flat plate on which the image receiving surface of the paper is pressed prior to the transfer at the final stage. The path over the plate and to the nip of the final stage is straight.

The foregoing patent to Britto et al is assigned to the same assignee to which this invention is assigned. This invention preferably employs those two stages and the straight-path for transfer. This invention also employs a prior stage in which the paper is thoroughly dried under heat and immobilizing pressure prior to moving over the heated plate. This dries and apparently otherwise conditions the paper to achieve excellent, consistent results with a wide range of papers.

In the Britto et al apparatus the transfer location has a relatively small second transfer roller, and that roller could be heated sufficiently high to effect transfer without unduly heating the larger, first transfer roller or being so hot as to cause fumes or emissions. In this invention, a large transfer roller may be one of the two rollers at the transfer location.

U.S. Pat. No. 5,204,722 to Thompson et al preheats the paper on a flat plate and mentions a purpose of driving "out excess moisture from the paper, particularly on the side to which the toner is to be transferred.'-'Such heating is not the preheating under immobilizing pressure of this invention.

DISCLOSURE OF THE INVENTION

In an electrophotographic imaging apparatus transfer of the final image to paper or other substrate is preceded by pretreating the substrate under immobilizing pressure and with heat sufficient to expel substantially all free water, the substrate is passed over a plate which heats the surface to receive the image, and then the substrate is passed through a nip of a member carrying a toner image and a transfer roller. The immobilizing stage preferably comprises heated pinch rollers with a pinch pressure sufficient to prevent wrinkling of the substrate while it is in that nip. The paper is thoroughly dried and otherwise conditioned (as by the heat driving off other volatile materials in the paper), and the substrate does not wrinkle subsequently as, once dried, it no longer tends to wrinkle when subsequently heated. This permits the plate to heat the paper to as high as required, generally up to 140 degrees C. Excellent transfer and consistent results are realized for a wide range of papers as the substrate without damaging level of heating of the members forming the transfer nip.

BRIEF DESCRIPTION OF THE DRAWING

The details of this invention will be described in connection with the accompanying drawing, in which.

BEST MODE FOR CARRYING OUT THE INVENTION

Figure 1:
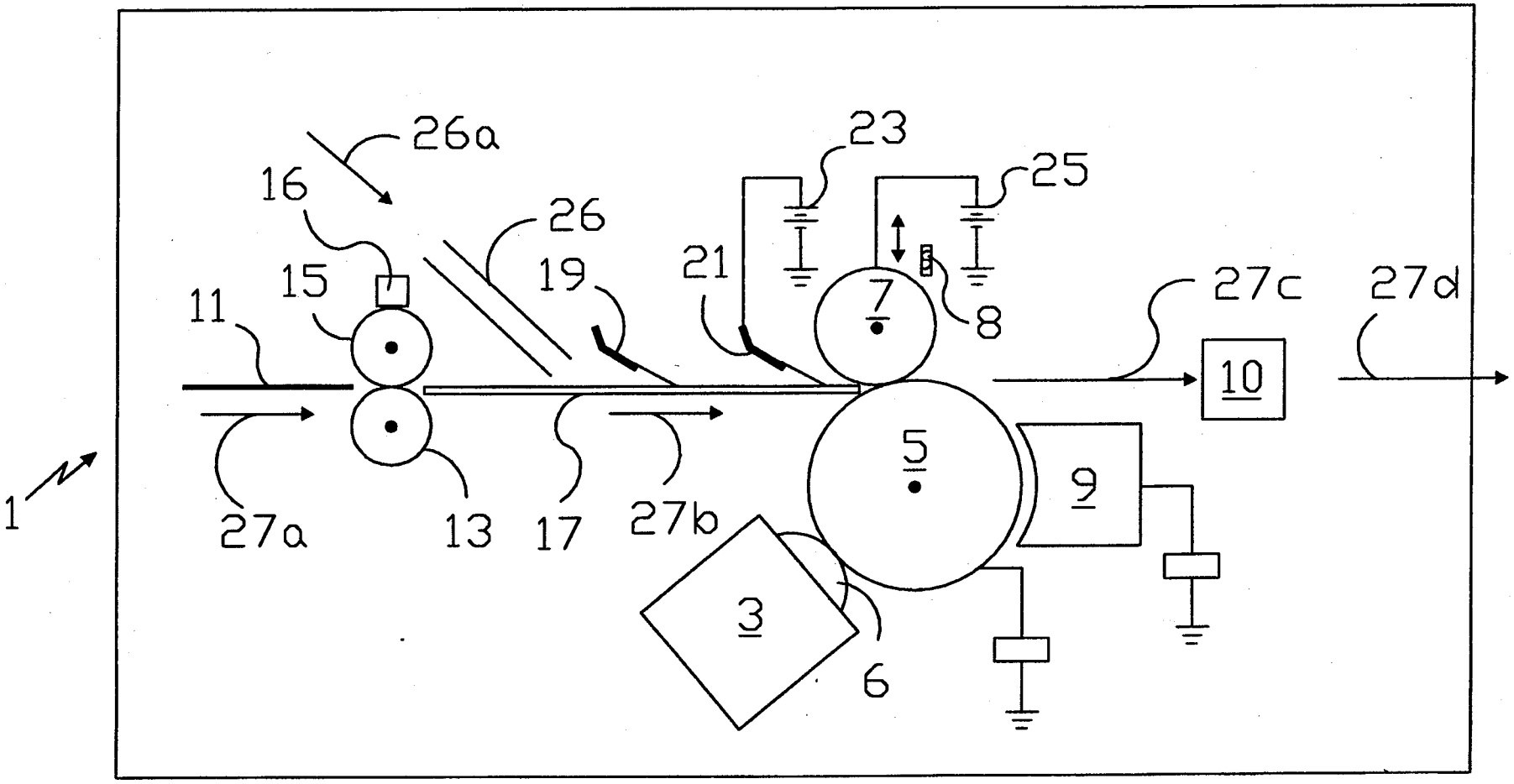
FIG. 1 is illustrative of a printer employing this invention.

As shown in FIG. 1, a printer 1 has an electrophotographic imaging stage 3 by which an image is transferred to an intermediate transfer, or accumulator, drum 5. The imaging stage 3 need not be unique to this invention. Typically a laser printhead will operate on a photoconductive drum 6 which is electrically charged. Toner, which may be dry or liquid, is applied to the photoconductor to develop the image. That image is transferred by pressure and electrical field to the intermediate transfer drum 5.

Toner is applied sequentially in three colors and in black to form a full-spectrum, colored image. Each toned image is transferred by contact with accumulator drum 5. For a colored image, imaging stage 3 separately creates the image of each of the three colors and black, and each image is separately developed and transferred to accumulator drum 5 in registration with the other images. Until the four images are on drum 5, transfer roller 7 is spaced away from intermediate transfer drum 5. To apply an image to the final paper, transfer roller 7 is moved downward, as by a solenoid 8, into contact with drum 5. A cleaning station 9 operates on drum 5 after each transfer of toned image at transfer roller 7. A fixing station 10 further heats the transferred imaged so that it flows into paper 11 to which it has been transferred and, upon cooling, is permanently fixed to paper 11.

The foregoing need not be novel to implement this invention and therefore is described only generally and illustratively. The printer would have a number of elements not mentioned to implement imaging stage 3 such as a cleaning mechanism for the photoconductor drum and an electrically biased squeegee roller to remove liquid from the toned images on the photoconductor.

Paper or other substrate 11 is delivered in the nip between lower drying roller 13 and upper drying roller 15. A cloth wiper 16 contacts upper drying roller 15. Paper 11 is then moved by rollers 13 and 15 face down on a heated plate 17. Resilient guides 19 and 21 together extend substantially entirely across the area of plate 17 which is occupied by paper 11 during operation to firmly force paper 11 against plate 17. Guide 19 is closest to drying rollers 13 and 15. Guide 21 is closest to transfer drum 5 and is electrically biased by a DC potential source 23 to counteract any tendency for paper 11 to take on an extraneous charge or the entire paper path is isolated from ground (thereby eliminating potential source 23). Transfer roller 7 is electrically biased by a DC potential source 25 to attract toner to paper 11 during transfer from drum 5, as is conventional.

Substrate guide 26, positioned above drying roller 13 and 15, is to supply substrates such a plastic transparencies, which do not require drying and which would be degraded by the heat of rollers 13 and 15. Arrows **26*a*, 27*a*, 27*b* and 27*c* show the direction of movement of substrate 11 in operation of printer 1. Arrow 27*d* suggest the exit of substrate 11 from printer 1** with a fixed image for access and normal use as a finished document.

One or both of the drying rollers 13 and 15 will have internal quartz filament lamps to heat the rollers 13 or 15. One of roller 13 or roller 15 is soft so as to assure the nip of rollers 13 and 15 conform to the paper 11. Drying roller 13 and 15 are typically heated to 160 to 180 degrees C., and the plate 17 is typically heated to 100 to 180 degrees C., depending upon the toner and paper types.

The image is transferred to paper 11 or other substrate at the nip of drum 5 and transfer roller 7. Most of the heat to melt toner to achieve this transfer is provided by the preheating, which elevates the temperature of the bottom face of substrate 11. The image side preheating of substrate 11 allows substantial reduction of the transfer roller 7 temperature from that which would otherwise be required from the transfer roller 7 and drum 5 to achieve the same temperature at the nip of drum 5 and roller 7. After fixing in station 10 paper 11 then exits printer 1 for normal access by an operator of printer 1 and for subsequent use as a final, permanent printed page.

Narrow print media, which leave large areas of direct contact between the drum 5 and the transfer roller 7, can be fed continuously without overheating the drum 5 because of reduced temperature at the transfer roller 7. Transfer to thick and rough paper 11 is excellent with this three stage transfer system, while that is not satisfactorily achieved by heating only the nip of the transfer roller 7 and drum 5.

With substrate 11 heated by the drying rollers 13 and 15, paper or other porous substrate 11 are dried of substantially all free water. This reduces variation in bulk and surface resistivity. This makes the entire transfer mechanism more reliable over environmental changes. When preconditioned by drying rollers 13 and 15, toned substrates 11 are not damaged by desirable electrostatic fields applied by potential source 23 to transfer roller 7. Papers 11 dried by rollers 13 and 15 receive transferred images with much less variation because of environmental conditions. After being dried by rollers 13 and 15, papers 11 do not subsequently deform even under high humidity conditions, and, in particular, do not wrinkle when further heated by plate 17.

Wiper 16 is a dry felt cloth which by contact captures all the rosins and fibers generated in the drying by rollers 13 and 15.

The melting point of toners in typical use is about 95 degrees C. This invention achieves heating of substrates 11 to about 100 degrees C. or higher without wrinkling paper or other porous substrates 11. This is particularly advantageous when the substrate 11 is exceptionally thick or rough paper.

The lower temperature of transfer roller 7 achieved by this invention prevents overheating of drum 5 and undesirable fumes from transfer roller 7. Removal of volatiles from paper 11, particularly rosins, prevents them from reaching drum 5 and thereby contaminating drum 5.

Locating drying roller 13 and 15 sufficiently close to the nip of transfer roller 7 and drum 5 is impractical in this embodiment since the two nips must be spaced apart so that the rollers 13, 15 do not occupy the same space as roller 7 and drum 3. Since plate 17 is heated, papers passing over plate 17 do not lose heat and therefore reach the nip of roller 7 and drum 5 at the desired high temperature. Increased length of plate 17 in the direction of movement **27*b* of substrate 11 permits increased heating of substrate 11 as may be desirable. Plate 17** may be heated to 160 degrees C., which is sufficient to dry all commercially significant paper weights. (The heavier the paper, the lower its temperature, but the heaviest, 140 pound index paper reaches about 102 degrees C., which is sufficient for the transfer.)

Figure 2:
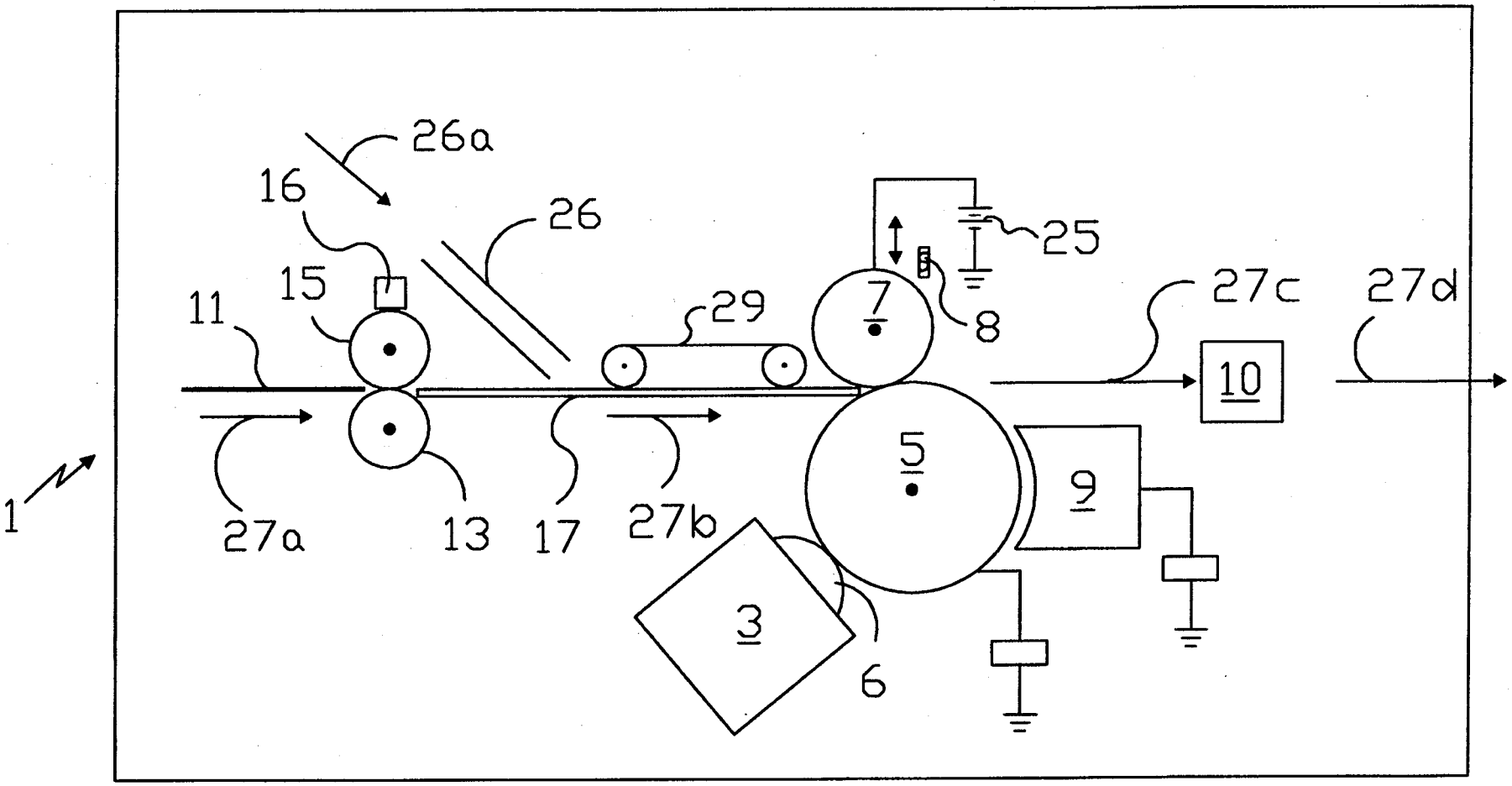
FIG. 2 illustrates the printer of FIG. 1 with an alternate paper feed.

Variations within the spirit and scope of this invention will be apparent and can be expected to be made in the future. FIG. 2 shows an alternate belt paper feed 29 above plate 17.

What is claimed is:

1. An electrophotographic imaging apparatus comprising means to form a toned image on an endless intermediate first transfer member, an endless second transfer member positioned to press paper or other image receiving substrate between said first transfer member and said second transfer member at a transfer location, means to condition said substrate by heating said substrate to a temperature substantially all free water from paper while said substrate is immobilized under pressure, means to move said substrate from said means to condition to said transfer location with the face of said substrate facing said first transfer member at a temperature above the melting point of said toned image.

2. The imaging apparatus as in claim 1 in which said means to condition said substrate comprises pinch rollers forming a nip through which said substrate passes, heated to high temperature sufficient to expel said free water and pressing said substrate in said nip with sufficient force to immobilize said paper.

3. The imaging apparatus as in claim 2 also comprising a heated plate between said means to condition and said transfer location on which said substrate slides and is heated before entering said transfer location.

4. The imaging apparatus as in claim 3 also comprising a fabric wiper contacting one of said pinch rollers to clean rosin from said pinch rollers.

5. The imaging apparatus as in claim 2 also comprising a fabric wiper contacting one of said pinch rollers to clean rosin from said pinch rollers.

6. The imaging apparatus as in claim 1 also comprises a heated plate between said means to condition and said transfer location on which said substrate slides and is heated before entering said transfer location.

* * * * *